United States Patent [19]

Toran

[11] Patent Number: 4,785,487

[45] Date of Patent: Nov. 22, 1988

[54] ADJUSTABLE ELECTROBED

[76] Inventor: Manuel B. Toran, Avda. Erasa, 10-2a fase, Benalmadena (Málaga), Spain

[21] Appl. No.: 921,590

[22] Filed: Oct. 21, 1986

[30] Foreign Application Priority Data

Oct. 30, 1985 [ES] Spain ..... 289995

[51] Int. Cl.[4] ..... A61G 7/06

[52] U.S. Cl. ..... 5/66; 5/67; 5/74 R

[58] Field of Search ..... 5/66, 67, 68, 72, 74 R, 5/74 B, 434, 436, 437

[56] References Cited

U.S. PATENT DOCUMENTS

| | | | |
|---|---|---|---|
| 3,530,514 | 9/1970 | McCalley | 5/66 |
| 3,763,507 | 10/1973 | Propst | 5/508 X |
| 4,136,409 | 1/1979 | Ishida | 5/66 X |
| 4,176,415 | 12/1979 | Dickerson et al. | 5/66 |
| 4,188,677 | 2/1980 | Zur | 5/66 |
| 4,221,213 | 9/1980 | Gregory et al. | 5/436 X |
| 4,356,578 | 11/1982 | Clark | 5/66 |

FOREIGN PATENT DOCUMENTS

| | | | |
|---|---|---|---|
| 37975 | 10/1923 | Norway | 5/74 |

*Primary Examiner*—Michael F. Trettel
*Attorney, Agent, or Firm*—Ladas & Parry

[57] ABSTRACT

An adjustable electrobed includes a head which is adjustable in height and which is formed by two pieces joined together at the center of the bed. The two pieces may be pivoted about the center by an arm attached to the outer edge of each piece. The arms are moved by a motor-driven spindle to raise or lower the ends to form a "V" shape about a longitudinal axis of the bed. The bed includes a spring-mattress comprising two rigid bodies hinged near the center of the bed and adjustable by means of motor-driven arms to vary the angle between the bodies.

A pneumatic mattress is superimposed on the spring-mattress and contains a cluster of slots for the arm of a patient. The elasticity of the pneumatic mattress is adjustable by changing its inflation pressure by means of a manual-pump-damper.

6 Claims, 17 Drawing Sheets

ADJUSTABLE ELECTROBED

BACKGROUND OF THE INVENTION

The present invention, as expressed by the title of this specification, consists of an adjustable electrobed.

The adjustable electrobed, object of the invention, comprises a series of devices used for adapting it to any position, depending on the user's weight and size.

The invention is conceived for the perfect rest of a person, under usual conditions. In addition, due to its characteristic elements, it can be used by any person who, due to his health state, must lie in bed for a long time. It provides the possibility of different comfortable positions, which would not be possible with standard beds.

SUMMARY OF THE INVENTION

The adjustable electrobed proposed by the invention includes a head supported by the spring-mattress, with adjustable height and adjustable to various horizontal positions, and two independent elements being articulated along a longitudinal axis, of the bed, being capable of forming a "V"-shape via its arms which control the head portions over a wide range of angles.

The spring-mattress comprises two articulated bodies along a transverse axis of the bed, the hinge area comprising a plurality of linked or zigzagged hinges, the angle being selected by one of them when the rest are blocked by "U"-shaped clamps, thereby varying the relative length of the rigid spring-mattress bodies with respect to the total length of the latter, being adapted in this way to the user's anatomy. The spring-mattress body being nearest the head has transversal slots with a preferably "L"-shape, at the shoulder level.

The mattress is put on top of the spring-mattress and is provided with slots corresponding to those of the latter. The mattress is a pneumatic mattress having its elasticity adjustable by varying the inflation pressure thereof by means of a manual pump-damper provided at the front body of the spring-mattress. The damper comprises a plurality of prismatic cells or attached air springs, being related among them by capillary drillings at their common faces, the pressure being balanced at said pneumatic damper, thereby automatically adapting to the user's weight.

The spring-mattress stands supported by a platform, out of which three pair of legs emerge, one of them being situated at a paracentral portion of the body of the spring-mattress, while the other two pair are at the farthest portions of the rear body thereof.

The means for achieving the head position at different levels, as well as the "V" shape thereof, include by two transverse small-spindles, each having a nut connected to the head end through articulated braces, said small-spindles being operated by an electric motor provided at the spring-mattress front body, and coupled by means of a pinion-transmission. In addition each of the independent head elements, are independently hinged, at their proximal end, to a support constituted by two telescopic pieces being operated by a coaxial spring, which can be blocked at the desired relative position, said support allowing the parallel and initial displacement of the head, followed by a "V"-displacement. The movements of the head can be stopped when desired by switching the electric supply off by means of the corresponding control knobs, by which the motor is operated in both.

The means for achieving the desired angular position of the spring-mattress independent hinged bodies, are related to the pairs of legs. Between the pair being nearest the head, two horizontal small-spindles, transverse to the bed, are provided. The rotation of these spindles provided by another electric motor which determines the linear displacement of both nuts and, through braces articulated with said nuts and at the spring-mattress front body, the subsequent angular displacement thereof with respect to the rear body. The central pair of legs also comprises another small-spindle operated by another independent electric motor, in order to displace in both directions, depending on the rotate of the motor, two threaded nuts, also related to the front portion of the spring-mattress rear body, by means of articulated braces. The rear pair of legs is pivotally anchored to the rear portion of the spring-mattress, as at this point only rotation thereof is produced and not an elevation, as is needed at the front portions, this elevation being higher at the front legs than at the central ones.

With this disposition of the legs, the spring-mattress rigid bodies can be angularly placed in a range from about 80° to 190°.

Each of the legs supporting the spring-mattress comprises a manual adjustable damping mechanism, as they are determined by a stem threaded at one of its ends to the inner mouth of an upper cylinder jacket, whilst its inner end is threaded to a platform hole, there being between the upper end of the threaded stem and the cylinder piston a damping spring, the stress off which may be adjusted depending on the user's weight, with the greater or lesser penetration of the threaded stem with regard to the cylinder jacket, by means of the former turn when operating a radial holding drive. With this disposition, although the spring stress is varied, the height of the leg stands unchanged.

According to the invention, it has been foreseen that the bed clothes are rolled up by a roller transversal to the bed, provided at the rear and lower portion of the spring-mattress, these bed clothes being able to be drawn out through a longitudinal window performed in a rear hatch of the spring-mattress.

BRIEF DESCRIPTION OF THE DRAWINGS

For a better comprehension of this specification and as a member portion thereof, there are some plans hereto attached, in the figures of which, with an illustrative but non-limitative character, the following has been represented.

DESCRIPTION OF A PREFERRED EMBODIMENT

Figure 1:
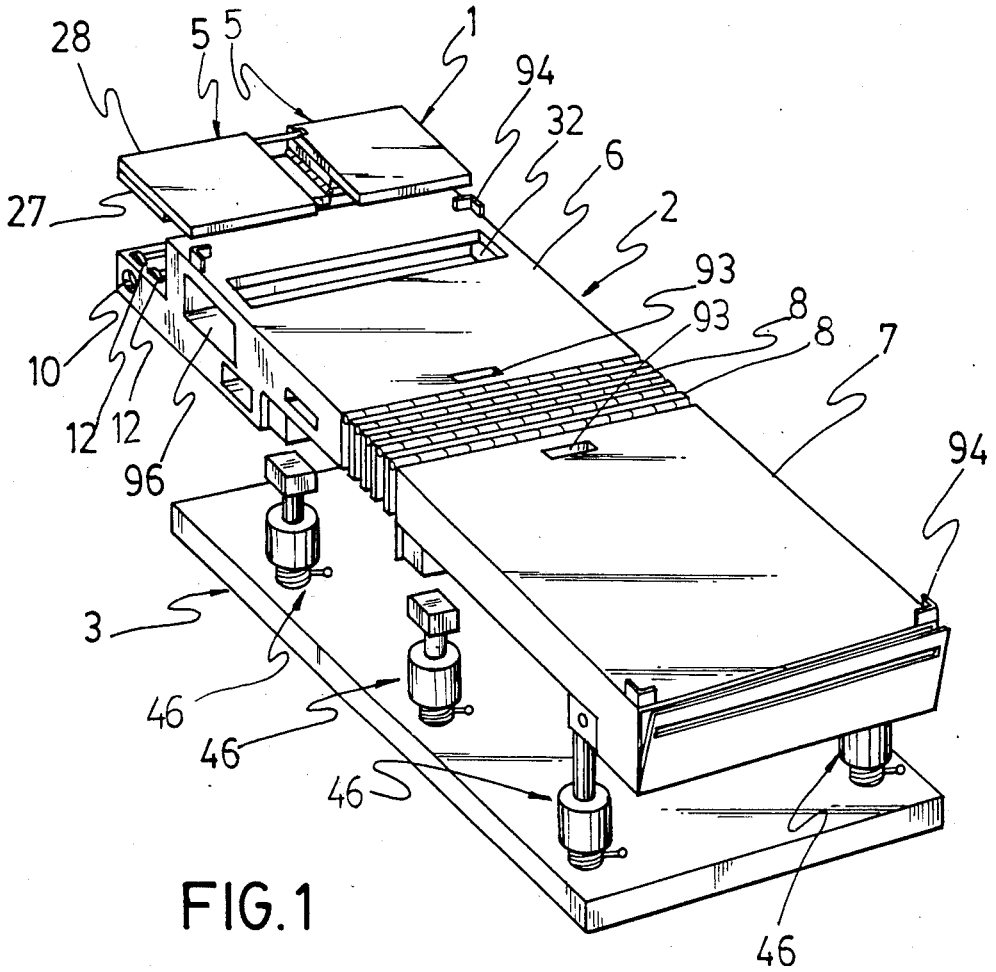
FIG. 1 is a perspective view of the adjustable electrobed of the invention, excluding the pneumatic mattress.
Figure 2:
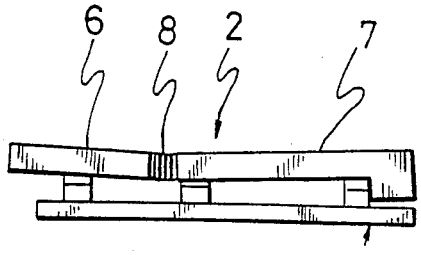
FIGS. 2 to 5 are schematic elevational views of the adjustable electrobed, in different positions of use.
Figure 3:
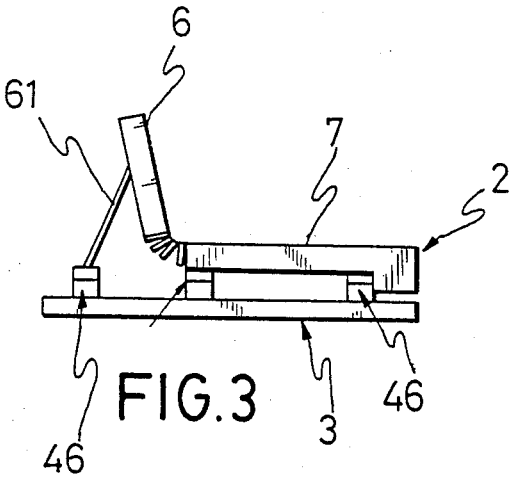
Figure 4:
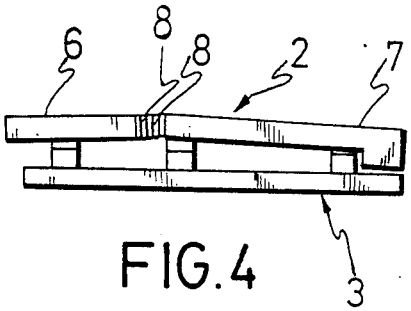
Figure 5:
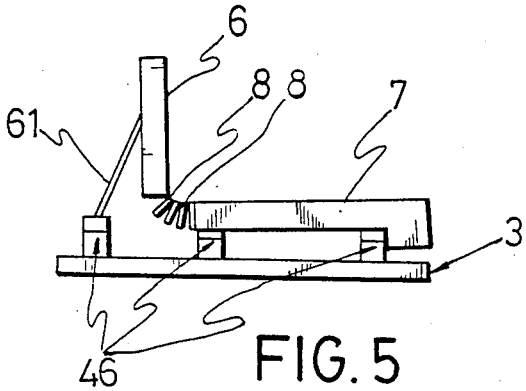
Figure 6:
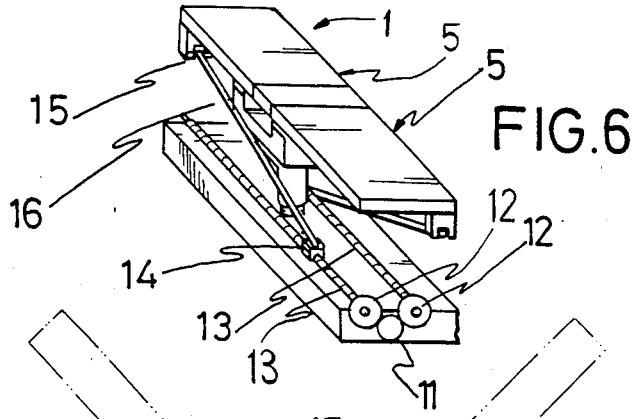
FIG. 6 is a perspective view of the front portion of the spring-mattress, wherein the adjustable head is supported.

With regard to the numeration indicated in the above-mentioned Figures, it can be seen how the adjustable electrobed proposed by the invention comprises four main components:

The head 1, the spring-mattress 2, the platform 3 and the pneumatic mattress 4.

The head 1 can be adjusted in height, it can move in a horizontal plane and, as it comprises two independent elements, generally referred to under number 5, it can adopt a "V"-disposition.

The spring-mattress 2 comprises two rigid bodies being hinged in-between at the paracentral area of the spring-mattress, being assigned number 6 to the front body corresponding to the area of the head 1, while the rear body has been assigned number 7. These bodies 6 and 7 of the spring-mattress are related to each other by a plurality of hinges 8 linked or zigzagged so that said bodies can adopt different angular positions such as shown in FIGS. 2 to 5. As it will be shown hereinafter, the relative angle of both spring-mattress bodies can be carried out by any of the parallel hinges in order to vary in this way the relative length of both with regard to the total length of the spring-mattress.

The head 1, the structure of which can be seen with more detail in FIGS. 6 to 9, achieves its position in height or in "V"-shape by the operation of an electric motor 9 (See FIG. 32), provided at a location 10 at one of the sides of the front body of the spring-mattress 2. This electric motor 9 comprises a pinion 11 (See FIGS. 6 and 32) permanently gear to two other conducted pinions 12 joined to the corresponding ends of both small-spindles 13 which are transverse to the spring-mattress 2. The turning movement of these spindles causes the displacement of both nuts 14 in opposite senses, as their screw thread and the screw thread of the small-spindle are opposite. The said nuts 14 are connected to the transverse ends of the independent head 1 elements 5, through the braces 15.

The longitudinal edges of the independent elements 5, of head 1, in a closed position, are articulated to a support 16 which emerges from the front body 6 of the spring-mattress 2, according to the respective articulation axes 17.

The head support 16 comprises two telescopic pieces 18 and 19, the first of which can move axially with regard to the piece 19, which remains welded to the spring-mattress and inside the piece 18.

Figure 7:
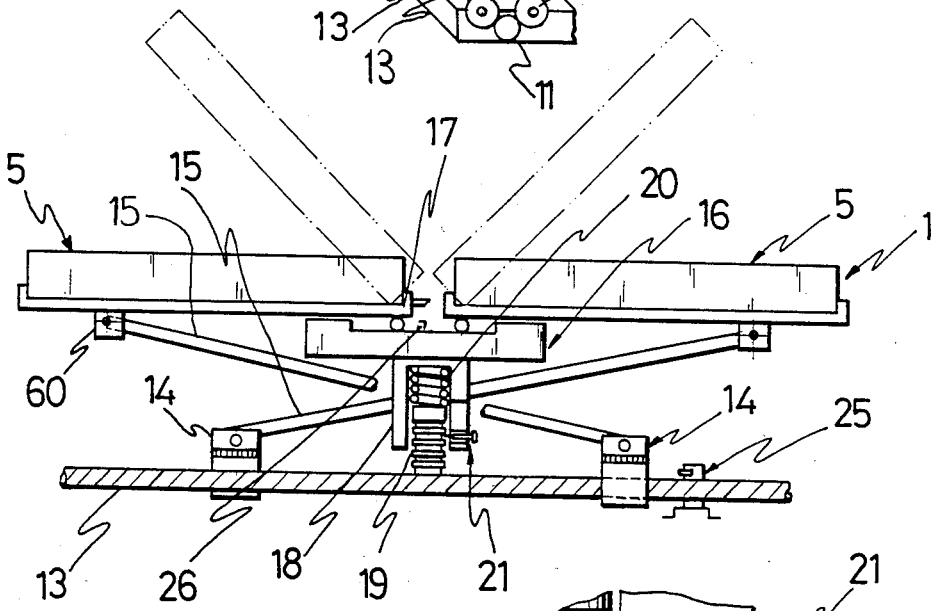
FIG. 7 is a posterior and elevational view of what has been represented in FIG. 6.
Figure 7A:
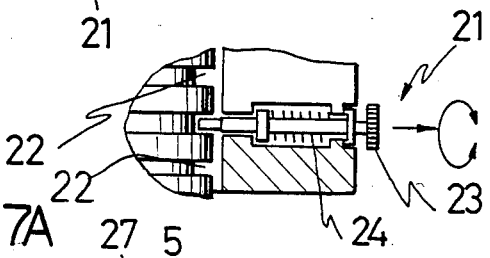
FIG. 7*a* shows the detail of the means for blocking the maximum displacement of the telescopic pieces of the head support.
Figure 8:
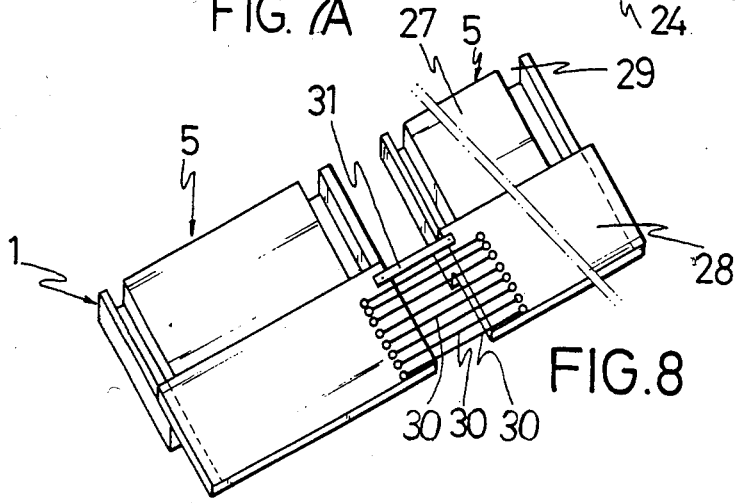
FIG. 8 is a partial view in perspective of the head, showing plates, the upper one sliding along guiding rails provided at the lower one.

Between both pieces 18 and 19 there is a co-axial spring 20, which keeps said pieces axially displaced, the maximum height of said support 16 being limited by blocking means 21, the structure of which is clearly seen in detail in FIGS. 7 and 8.

This blocking means 21 are determined by a plurality of ring slots 22 on the telescopic piece 19. The inner end of the blocking control 23 is urged by spring 24, into a pre-selected one of the slots.

During the descent of the head, the control end acts as a pawl in order to make the displacement possible, or it can freely move in a longitudinal slot of the piece 18, as shown in said FIG. 7.

When motor 9 elevates the head 1, the support goes up parallelly helped by the spring 20, which was compressed at the head lowest portion. During the elevation process, the elevation of the telescopic piece 18 is limited by the blocking means 21. The angular displacement of the braces 15 causes, the head 1 elements 5 seesaw in a "V" manner around the axes 17, and they can reach an angle of about 90°, as shown by the dotted lines of FIG. 7. If the control 23 of the blocking means 21 has been previously positioned at an inoperative position wherein its end is not included in any of the slots 22, the "V" adjustment is achieved once the spring 20 has released all its stress. The limit positions for the adjustable head 1 are achieved by means of the detectors or microbreakers 25 and 26, the first of which is bridged over one of the small-spindles 13 and upon which the corresponding nut 14 works at the lowest position of the head. The microbreaker 26 is operated when one of the head 1 independent elements 5 adopts an angular disposition of about 45° and when a welded pin emerging from it acts thereupon.

As it can be clearly seen in FIG. 8, the head 1 independent elements 5 each comprise two superimposed plates referred to with numbers 27 and 28, which can move due to the fact that the lower fixed plate 27 includes guiding slots 29 for the upper movable plate 28.

The movible plates 28 are joined to each other by rubber bands 30, by means of which the continuity at the head 1 is acheived, at the same time allowing for the "V" position thereof. The displacement of these movable plates 28 is manual and is carried out by acting on the holder 31.

Figure 10:
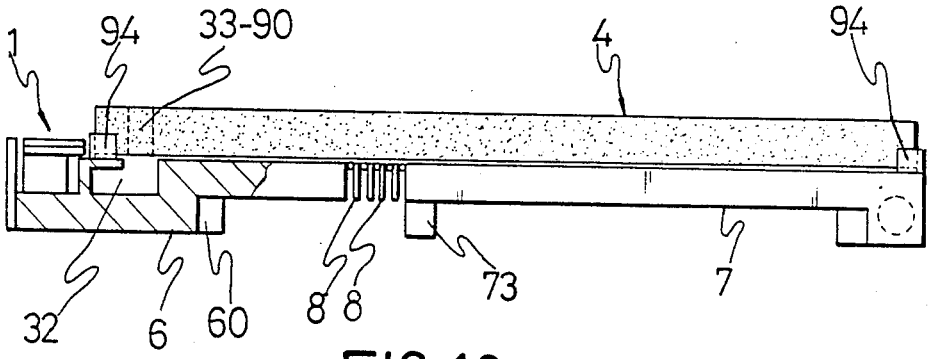
FIG. 10 is a lateral elevational view of the spring-mattress, also including the pneumatic mattress.

As it can be seen in FIGS. 1 and 10, the front body 6 of the spring-mattress 2 comprises a transverse "L"-shaped cluster of slots 32, which also exists accordingly at the mattress 4, this latter cluster of slots being referred to with number 33.

Figure 9:
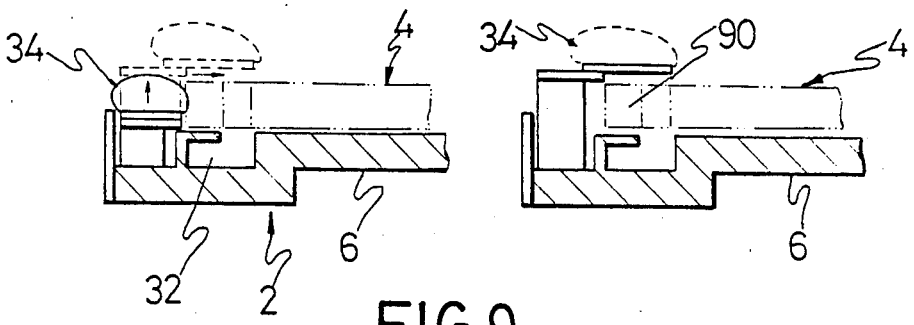
FIG. 9 is a partial and elevational lateral view of the head supported on the spring-mattress, wherein the two height limited positions of said head are shown.

FIG. 9 shows the maximum and minimum height positions which the head 1 may adopt, as well as the maximum front and rear positions of the movible plates 28 thereof, showing with number 34 a pillow arranged on said head 1. In FIG. 9 and on the side thereof, it can be seen how the movable plates 28 reach the point to cover the transverse cluster of slots 33 of the mattress 4, this displacement being able to be made even when the plates adopt a "V" disposition.

Figure 11:
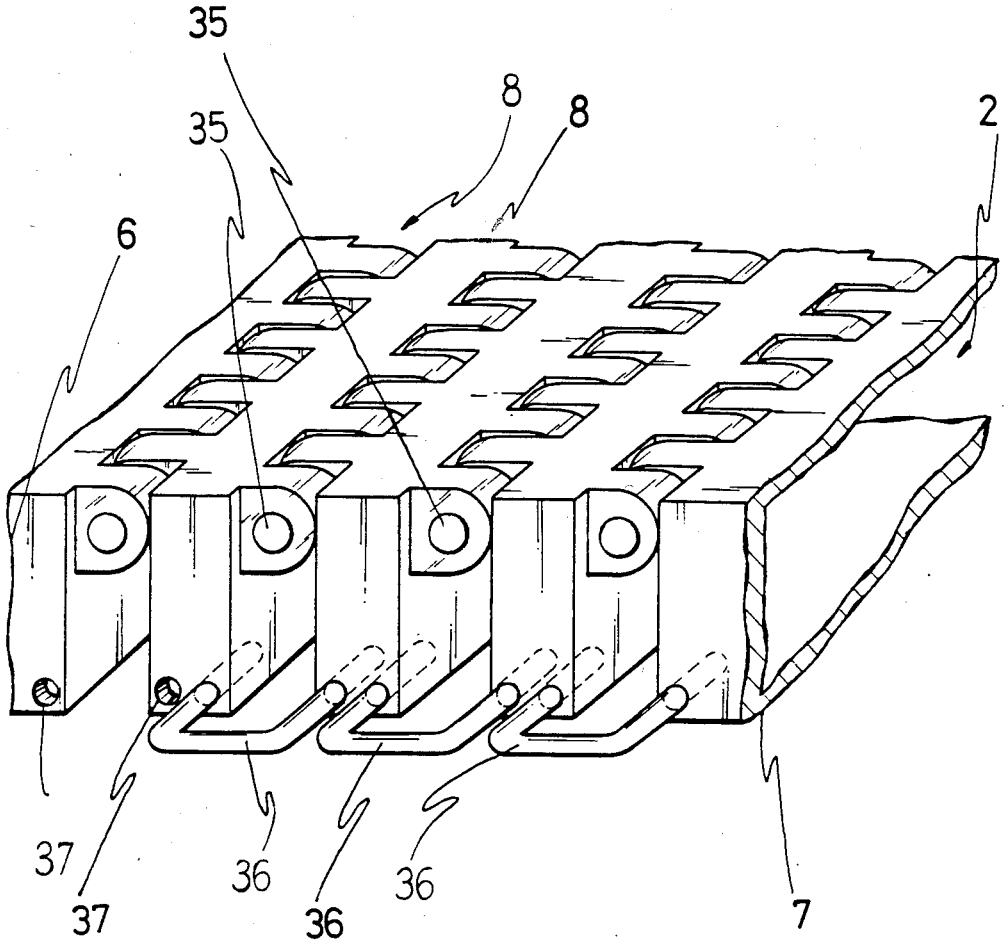
FIG. 11 is a partial view in perspective of the spring-mattress, corresponding to the hinge area between the two rigid and independent bodies it comprises.

Referring now to FIG. 11, wherein the hinges 8 of the spring-mattress 2 are shown, it can be clearly seen how the angle of the independent bodies 6 and 7 can be achieved by any of the articulation axes 35, with no more than positioning the blocking clamps 36 in the holds 37, with the exception of those corresponding to the axis 35 selected for the angle. In FIG. 11, the angle is around the articulation axis situated on the left, only needing to remove the clamp 36 situated under any of the other articulation axes 35 and to position it in the holes 37 for arranging the hinge over this new axis.

Figure 12:
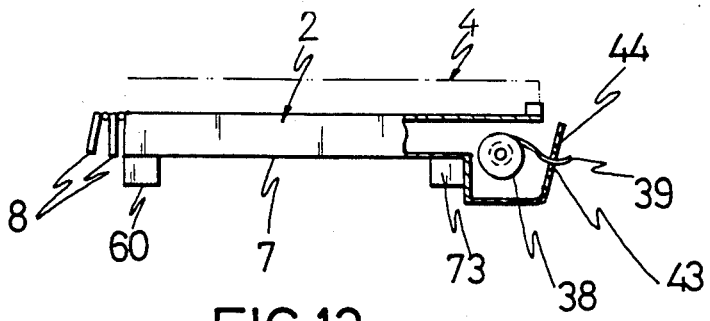
FIG. 12 is a lateral elevational, partially sectioned, view of the rear body of the spring-mattress, including the roller which rolls up the bedclothes which may be used.
Figure 13:
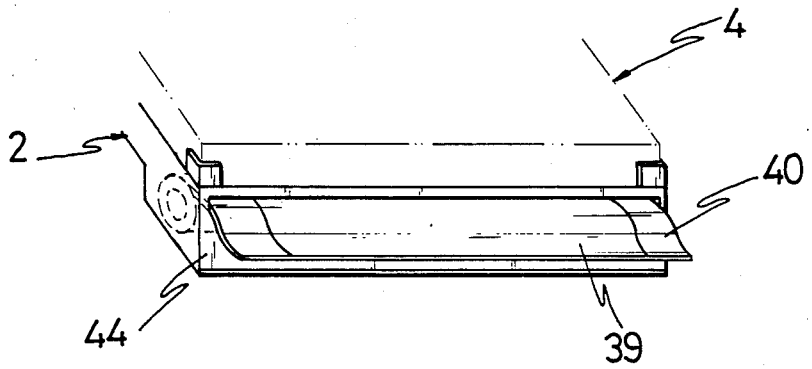
FIG. 13 is a partial view in perspective from the rear area of FIG. 12.
Figure 14:
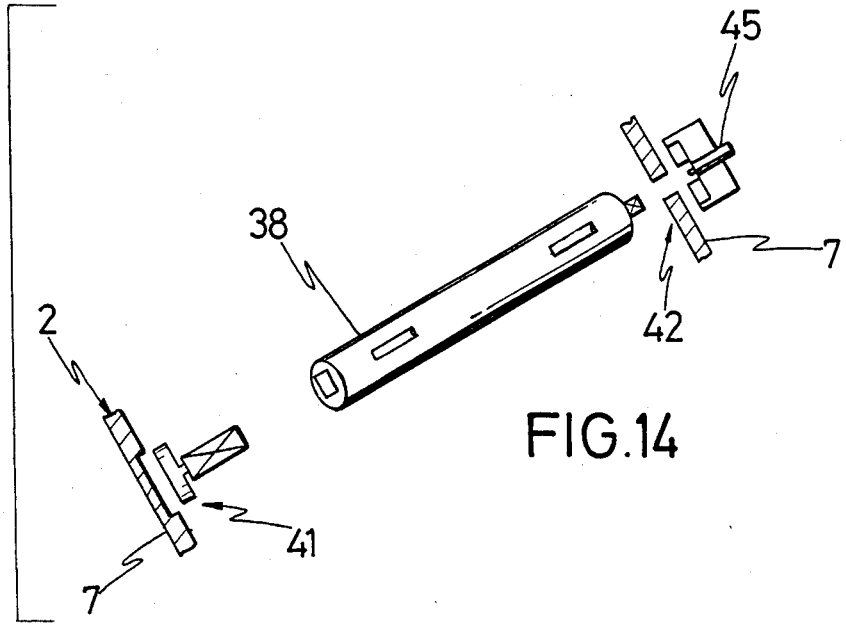
FIG. 14 is an exploded view in perspective of the anchoring and turning means of the roller used for the bed clothes, corresponding to FIGS. 12 and 13.

The rear body 7 of the spring-mattress 2 comprises, at its lower and posterior part, one or several rolls 38 around which the bed clothes 39 which may be used are rolled up, with the fringe 40 being folded. Said rolls are arranged between two spring tensioning mechanism, generally referred to with numbers 41 and 42 in FIGS. 12 to 14. When the clothes coming out through a slot 43 of a posterior lid 44 are unrolled, said springs are increasing tensioned. So as to pick up the clohes it is only needed to push the release 45 emerging from the spring-mattress side to the outside and, thus, the previously acquired stress makes the roller 38 turn in the sense of rolling the clothes up.

When the clothes have been spreaded over the mattress, the fringe 40 is pulled outwards in order to adapt it over the lateral faces of the mattress 4.

Figure 15:
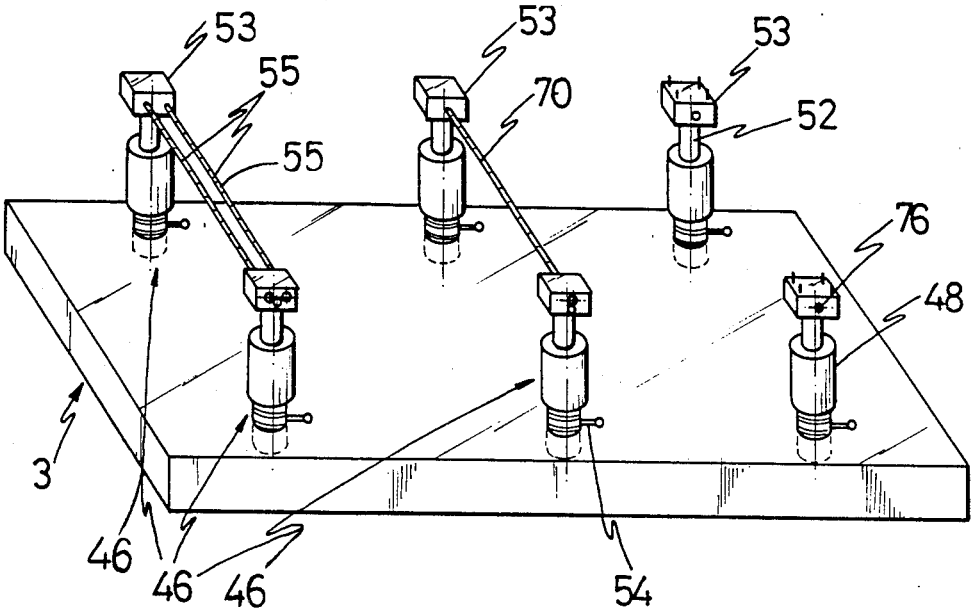
FIG. 15 is a view in perspective of the platform for supporting the damping legs, being adjustable, for the support of the spring-mattress.
Figure 16:
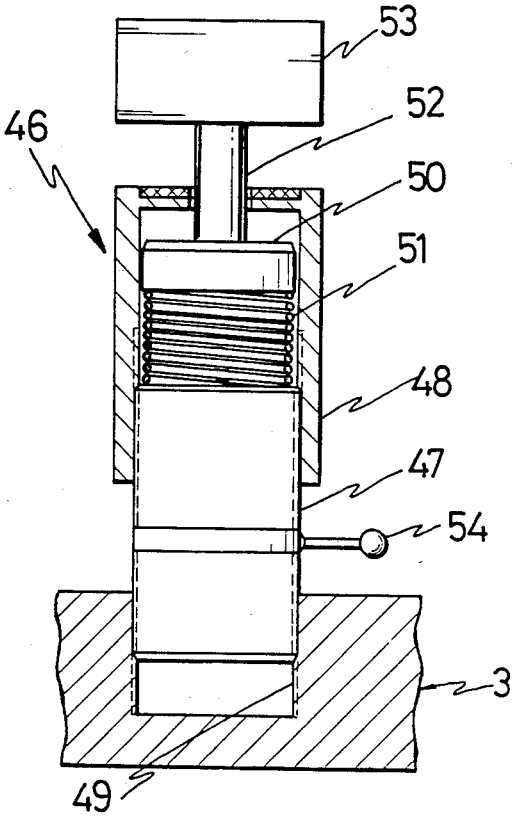
FIG. 16 is an elevational section of one of the damping legs, adjustable, corresponding to FIG. 15.

The platform 3 supports all the weight of the spring-mattress and head asssembly by means of three pair of legs 46 being adjustable, as shown in FIGS. 1 and 15. Each one of these legs 46 includes a damping mechanism, as they comprise a stem 47 threaded to the inner mouth of a cylinder 48 jacket. The lower end of said threaded stem 47 is anchored in the same way to a hole 49 of the platform 3, as it can be more clearly seen in the enlarged detail of FIG. 16. The piston 50 is situated inside the jacket 48 is operated by a co-axial spring 51 which urges it towards the bottom of said jacket, its stem 52 emerging from it and including in its free end a plug 53.

With this disposition of legs 46 it is possible to control their damping function with regard to the user's weight, since the spring 51 can vary its stress depending on the greater or lesser penetration of the threaded stem 47 inside the jacket 48, when the radial drive 54 is manually operated. At the same time that the stem 47 is threaded into cylinder 48 in order to supply a greater stress to the spring 51, it is unthreaded from the platform 3, the spring-mattress height thereby staying constant with regard to the platform.

Figure 17:
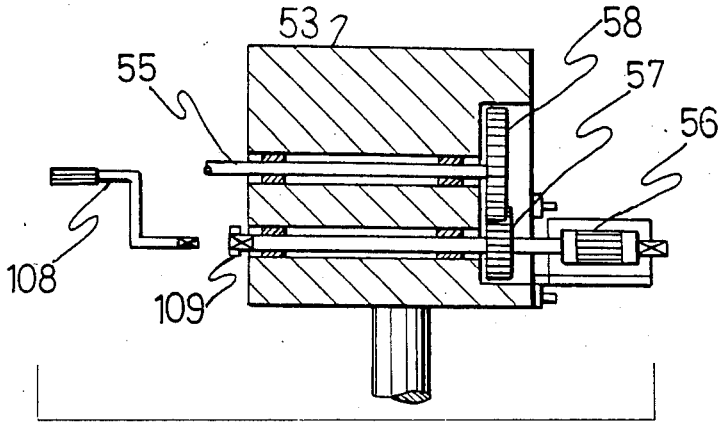
FIG. 17 is an elevational section of the upper portion of the legs, including the motor and the operation small-spindles and nuts for the angular positioning of the front body of the spring-mattress.
Figure 18:
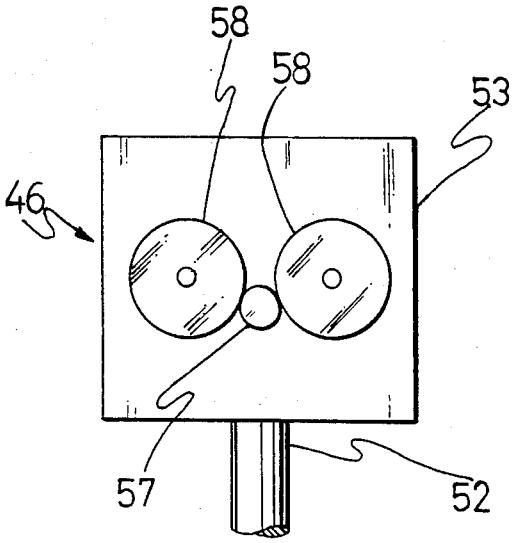
FIG. 18 is a schematic lateral elevational view of what has been represented in FIG. 17.
Figure 20:
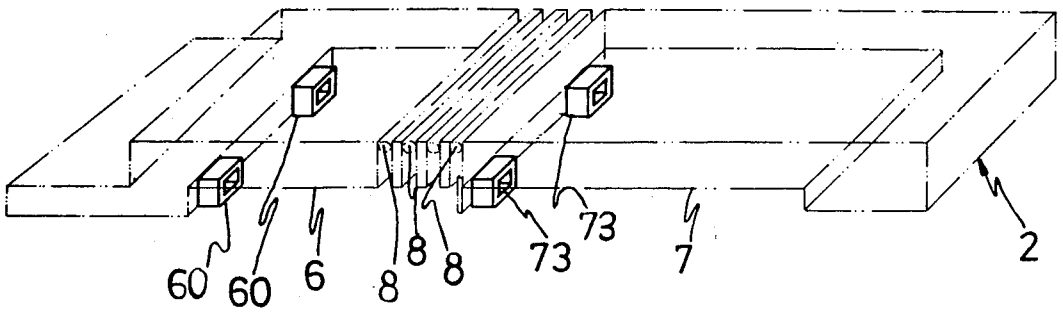
FIG. 20 shows schematically the position of the points of anchoring of the articulation braces for the relative angular positioning between the independent spring-mattress bodies.
Figure 23:
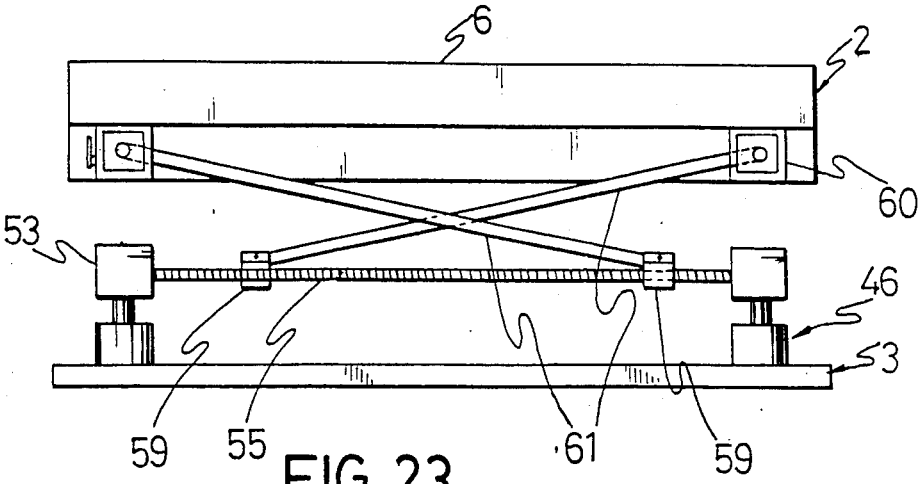
FIG. 23 is a front elevational view of the small-spindle and nut mechanism for the elevation of the front body of the spring-mattress.

In order to achieve the different relative positions shown in FIGS. 2 to 5, between the two bodies 6 and 7 of the spring-mattress 2, in a preferred embodiment shown in the Figures, that the pair of legs 46 being nearest the head, are related to each other by two small-spindles 55, being horizontal and transversal to the spring-mattress. The ends of which are located at the plugs 53 of the legs and in a parallel disposition, being operated by an electric motor 56 the outlet pinion 57 of which is constantly engaged to both pinions 58 welded to said small-spindles 55 ends, as shown in FIGS. 17 and 18. The turning of these small-spindles 55 cause the displacement in opposite senses of the nuts 59 being complementary to threads on the transmission mechanism small-spindle, said nuts 59 being related to corresponding supports 60 of the upper body 6 of the spring-mattress 2, by means of braces 61 (See FIGS. 20 and 23). When the electric motor 56 is operated so that the nuts 59 approach each other, the braces 61 cause the angular elevation of the upper body 6 of the spring-mattress 2, by articulating it on the selected hinge axis 35.

Figure 21:
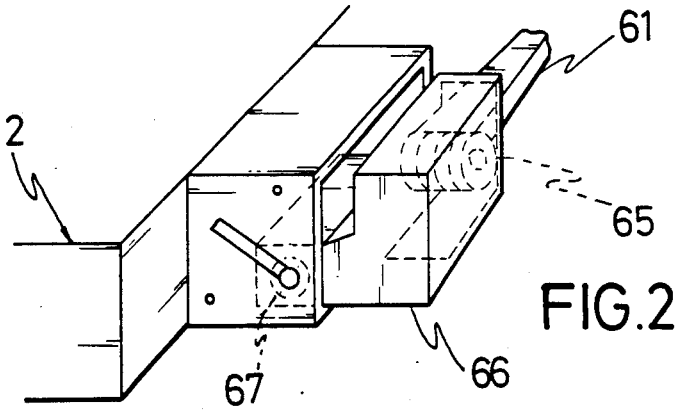
FIG. 21 is a detail of what has been shown in FIG. 20, wherein one of the articulation points and the anchoring of the articulated brace can be seen, through an intermediate plug for allowing the turn of said brace according to two freedom degrees.
Figure 24:
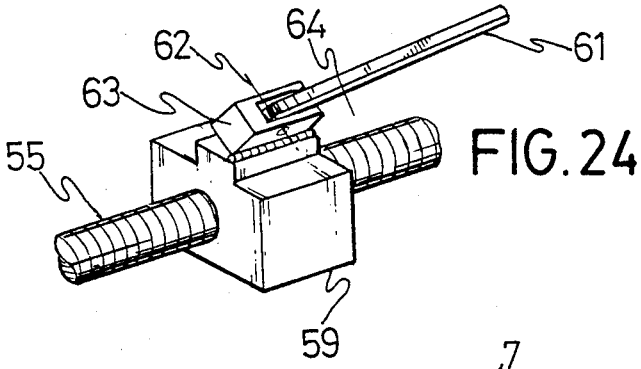
FIG. 24 is an enlarged detail of one of the nuts threaded to the small-spindle for the elevation of the spring-mattress, both elements, nut and spring-mattress being related to each other by the corresponding articulated brace.
Figure 25:
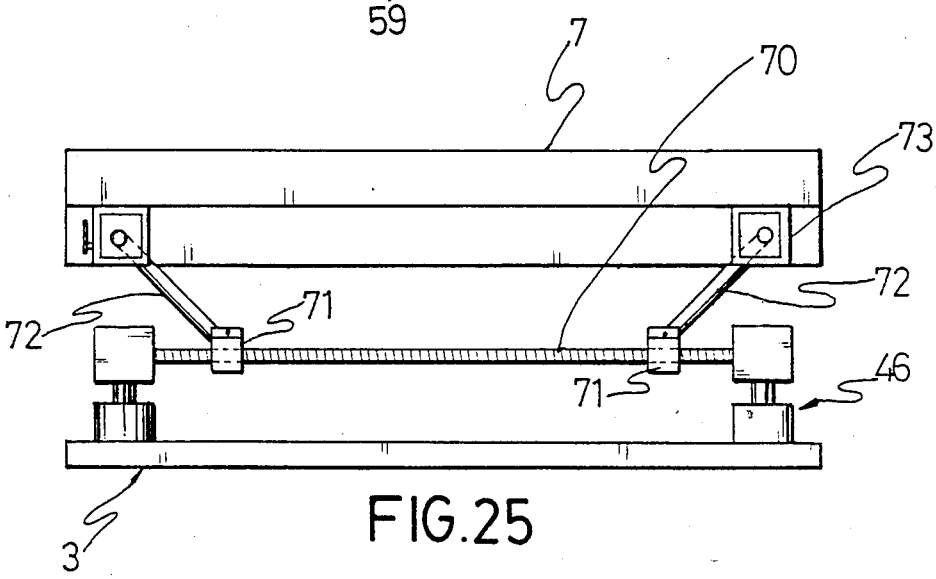
FIG. 25 is a view similar to that of FIG. 23, corresponding to the central pair of legs.

According to FIGS. 21 and 24, the ends of each one of the braces 61 are articulated to the nut 59 and to the support 60, with two freedom degrees. In order to make possible the angular elevation of said upper body 6 of the spring-mattress 2, the brace moves simultaneously in its plane at the same time that said plane adopts different angular positions with respect to the platform 3. The articulation between the brace 61 and the nut 59, corresponding to FIG. 24, takes place around an axis 62 being transverse to the brace 61, the latter staying placed in a piece 63 which is articulated to the nut 59 according to a hinge axis 64. The articulation of the brace 61 with respect to the support 60 corresponding to the spring-mattress 2, according to FIG. 21, takes place around an axis transverse thereto, assigned number 65 and being supported on another piece 66 which is articulated on an orthogonal axis 67 being anchored to the support 60.

Figure 22:
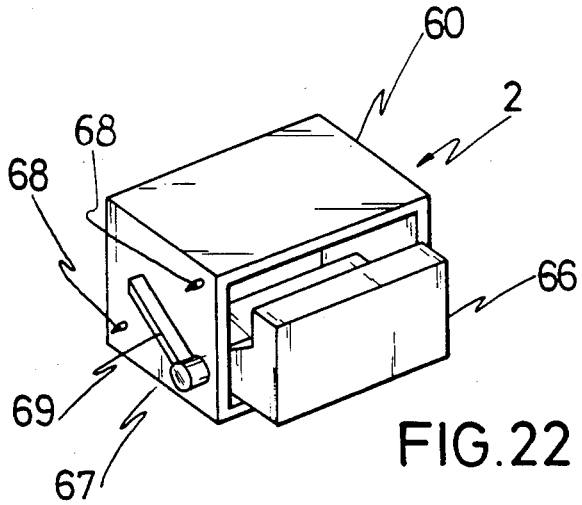
FIG. 22 is a partial view in perspective similar to that of FIG. 21, wherein it can be clearly seen the disposition adopted by two run ends which limit the maximum and minimum angular position of the spring-mattress.

In order to limit the angular displacement at the spring-mattress 2 articulation, microbreakers 68 are arranged to one of the supports 60 of the front body 6 of the spring-mattress 2, and are alternatively operated at the maximum and minimum positions, by a radial pawl 69 welded in turning to the axis 67 of articulation of the piece 66 of anchoring of the brace 61, as shown in FIG. 22.

Figure 19:
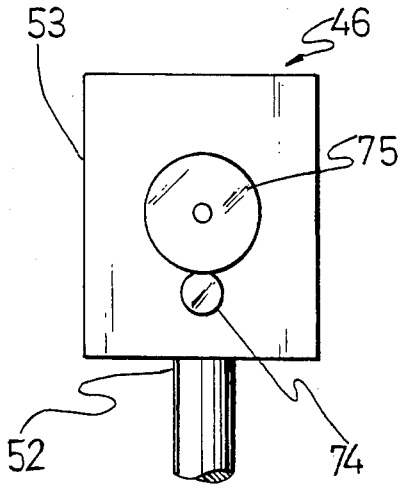
FIG. 19 is view similar to that of FIG. 18, corresponding to the small-spindle operation system, said small-spindle being provided between the central pair of legs and angularly elevating the rear body of the spring-mattress.

The central pair of legs 46, according to FIG. 15, includes an elevation mechanism for the front area of the rear body 7 of the spring-mattress 2, having similar characteristics to those which have been described for the front legs. The only difference is that between the plugs 55 of the latter there is only a small-spindle 70 wherein two nuts 71 move, these ones being anchored to the braces 72, the other ends of which are articulated to the corresponding supports 73 provided at the rear body 7 of the spring-mattress 2. The articulation of said braces with respect to the nuts 71 and to the supports 73, is similar to the one having been described for the mechanism corresponding to the front pair of legs. As it is inferred when observing the different articulated bed positions in FIGS. 2 to 5, the elevation of the rear body 7 of the spring-mattress 2, takes place in margins of about 10°, on the basis of which only one small-spindle is needed, this one having from its central point a screw thread opposite to that of the other end, so that the nuts 71 approach or move away in opposite senses, this being a preferred embodiment of the invention, although a similar mechanism could have been used. The small-spindle 70 is operated by another independent electric motor likewise provided with a pinion 74 which operates the pinion 75 being welded to the small-spindle 70 (see FIG. 19).

The rear pair of legs 46 have their upper plug 53 articulated to the stem 52 and directly joint to the rear portion of the spring-mattress 2, since in this area there is no elevation of the spring-mattress, but only an angular movement and, consequently, there is no need of small-spindles or attached motor. The articulation at this area has therefore only a degree of freedom around a transversal axis 76, as shown in FIG. 15.

According to FIGS. 26 to 30, the pneumatic mattress 4 comprises a plurality of cells 77 or air springs, joined and perforated in their common faces, according to calibrated holes 78 which restrain the air flow in and out depending on the user's weight. In order to obtain the same elasticity as that of the pneumatic mattress 4, independently on the user's weight, the remaining air, when the mattress is compressed, is obliged to pass towards the manual pump-damper, generally referred to with number 79 in FIG. 30, through a flow conduit 80. The manual pump is arranged at the front body 6 of the spring-mattress 2 which allows the pneumatic mattress to be inflated through the conduit 80, in order to regulate the elasticity of the mattress.

The manual pump 79 comprises an extensible grip 81 for operating the piston 82 of the pneumatic damper. During the descending stroke of the piston 82, the valve 84 is closed for sending air to the mattress 4, the outer valve 85 being opened in order to receive air. During the ascending stroke of the piston 82, the outer valve 85 is closed and the inner valve 84 is opened, the air passing then under pressure from the upper piston chamber towards the lower chamber thereof. When the manual pump 81 is not operated any longer, the pressure of both chambers of the damper 83 is balanced and, therefore, when the pressure in the mattress is increased due to the user's weight, the inner chamber will receive the excess of pressure, making the cylinder 82 move and the pressure being checked in the manometer 86.

An escape valve 88, being operated by a pulsator 89, is provided at the conduit 87 of the pneumatic circuit leading to the manometer 86.

Figure 26:
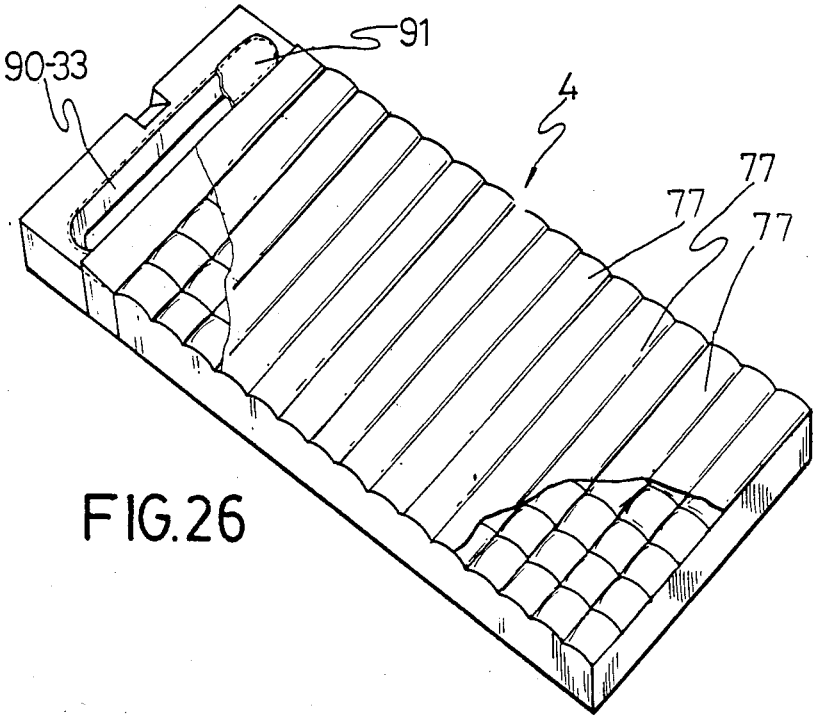
FIG. 26 is a view in perspective of the pneumatic mattress, including in the front area thereof a transversal "L"-shape group of slots, coinciding with that of the spring-mattress.

As far as FIG. 26 is concerned, it can be seen how the pneumatic mattress 4 comprises at its front areas a transverse cluster of slots 90 in correspondence with the "L"-shaped cluster of slots 32 provided at the spring-mattress 2, said cluster of slots 90 being able to be plugged by means of an elastic surface 91 provided with a rack, by which the upper surface of the mattress can be flat.

The mattress portion around the slot 90 may be manufactured from any soft material, such as foam-rubber, so that it gives way against the pressure of the head 1 when this adopts its lowest and most advanced position, wherein it plugs said cluster of slots 90 (see right position in FIG. 9).

Figure 27:
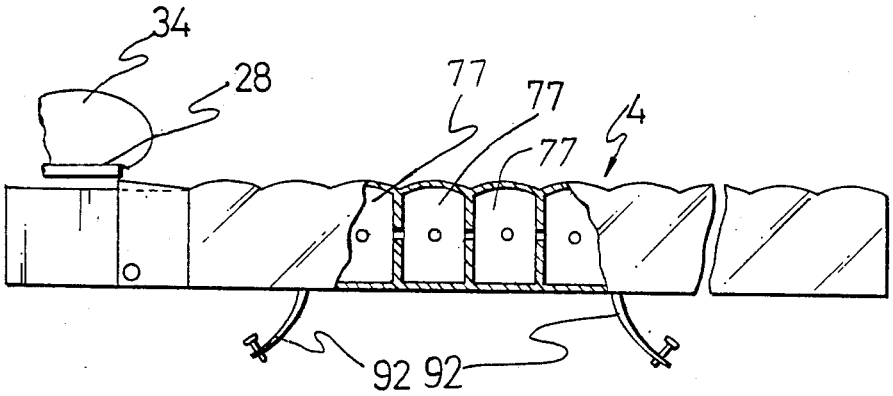
FIG. 27 is a longitudinal elevational view of the mattress shown in FIG. 26, partially sectioned.
Figure 28:
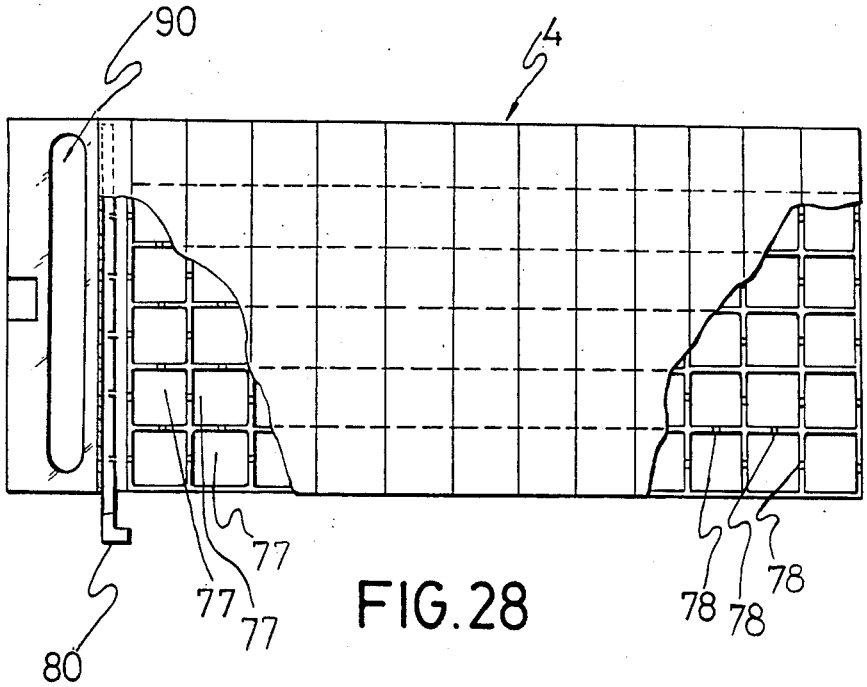
FIG. 28 is a partially sectioned view from above of the mattress shown in FIG. 26, including the conduct for the air intake and exit, being related to the manual pump-damper, in order to achieve an adjustable elasticity.
Figure 29:
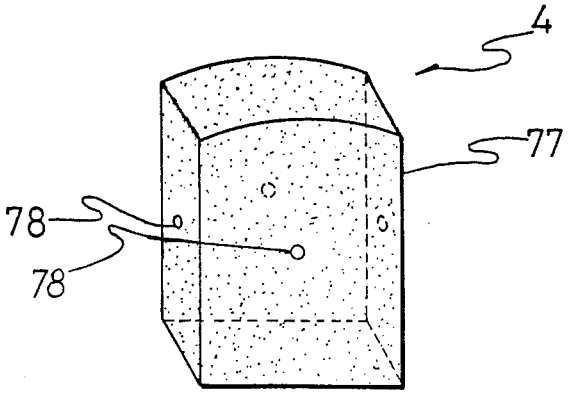
FIG. 29 is a view in perspective of one of the cells constituting the pneumatic mattress.
Figure 30:
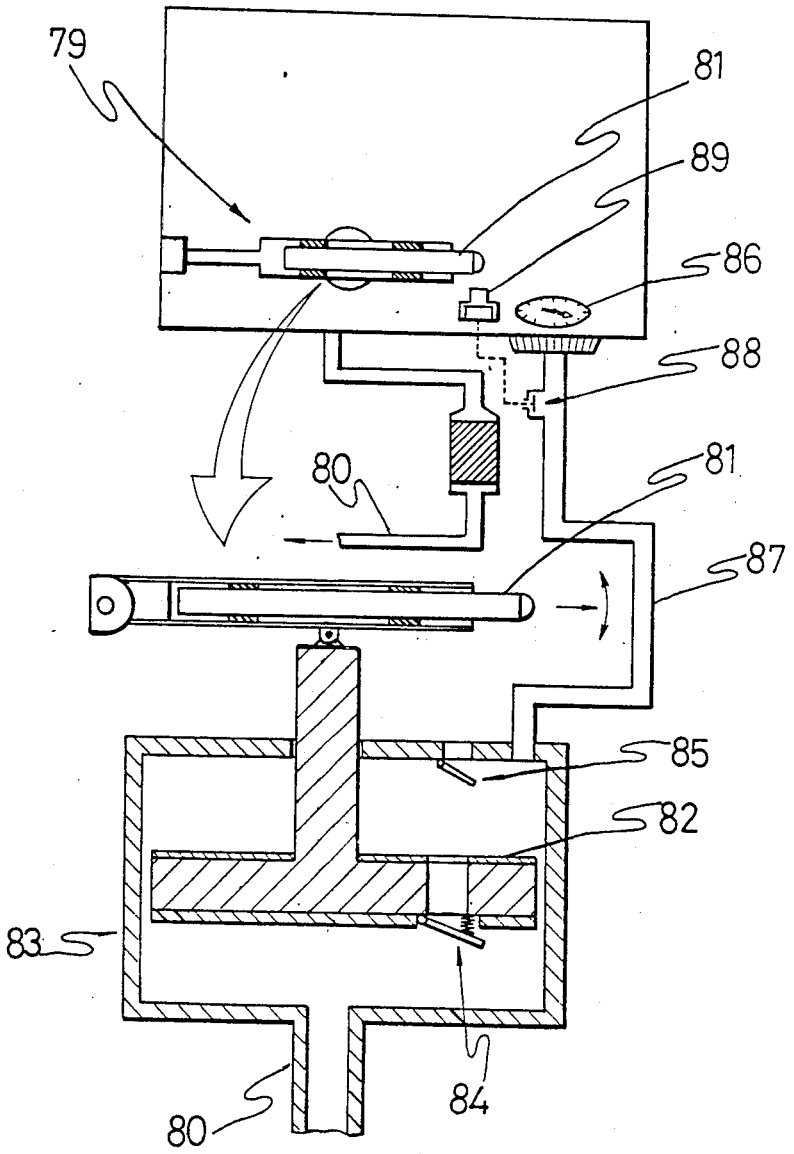
FIG. 30 is a schematic elevational view of the manual pump-damper arranged at the front body of the spring-mattress.

As it can be seen in FIG. 27, the pneumatic mattress 4 can be fastened to the spring-mattress 2 by means of the projections 92 emerging from the inner face thereof, which are made to pass through the windows 93 provided at the spring-mattress 2 bodies 6 and 7 (see FIG. 1).

The pneumatic mattress 4 is positioned with respect to the spring-mattress 2 by adjusting its corners at both butts 94, such as shown in FIGS. 1 and 10.

Figure 31:
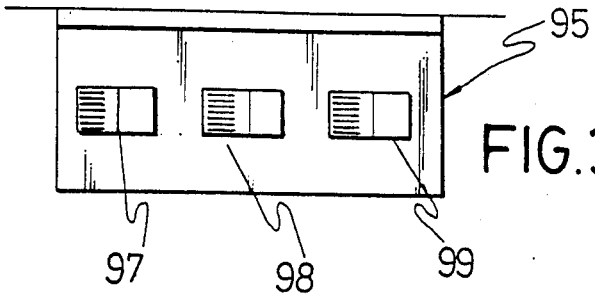
FIG. 31 is a schematic elevational view of the control board situated at the front body of the spring-mattress, including the operation knobs of the different electric motors for the elevation of the head, the turn of the front legs small-spindles and the turn of the rear legs small-spindles.

The electric motors for the operation both of the head 1 and for the spring-mattress 2, are driven from a control board 95 arranged at a location 96 provided on a side of the front body 6 of the spring-mattress (see FIG. 1), said board 95 being shown in FIG. 31.

The board 95 includes a two-position switch 97 for the elevation and descent of the head 1; another analogous switch 98 achieves an identical movement for the displacement of the braces being related to the front legs; and, finally, the switch 99 is used for causing the operation in both senses of the angular positioning motor of the rear body 7 of the spring-mattress 2.

Figure 32:
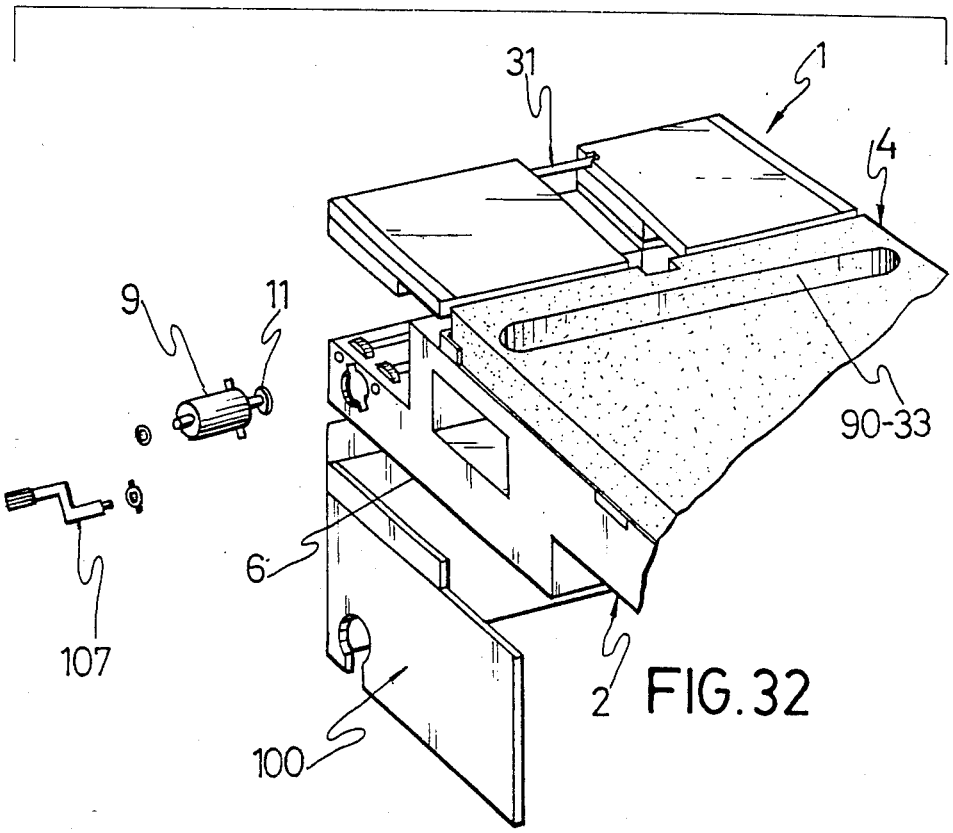
FIG. 32 is a partial view in perspective of the adjustable electrobed, corresponding to the head area, wherein a side platform, covering the head elevation mechanisms, can be seen in an exploded perspective.

FIG. 32 shows how the sides and the front face of the front body 6 of the spring-mattress 2 are protected by a cover 100 together with the front body 6 covers the head elevation mechanism.

Figure 34:
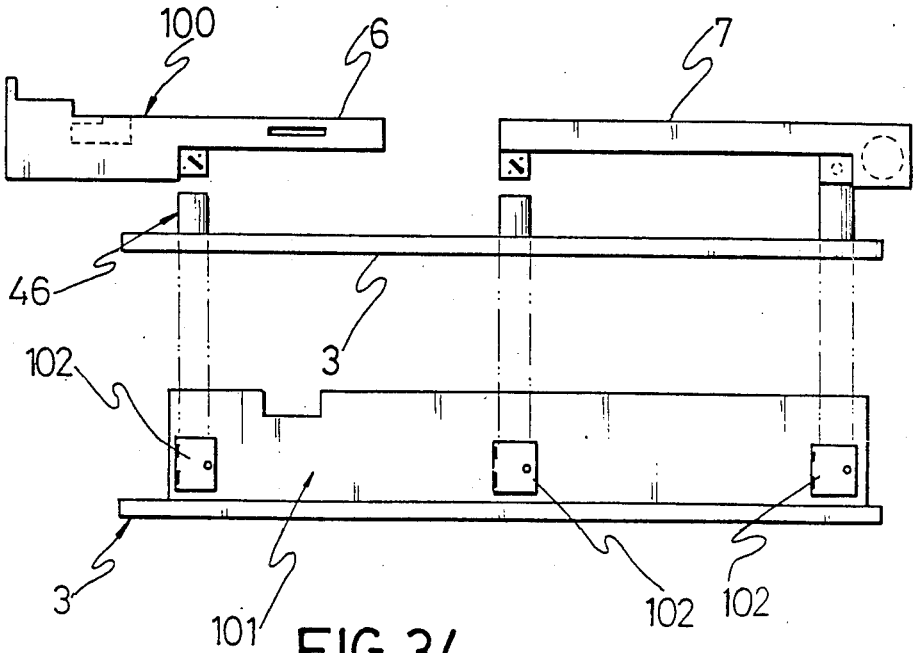
FIG. 34 is a lateral elevational view, wherein one of the lateral bed covers, provided with the gates for the access to the adjustable legs, can be seen in an exploded view.
Figure 35:
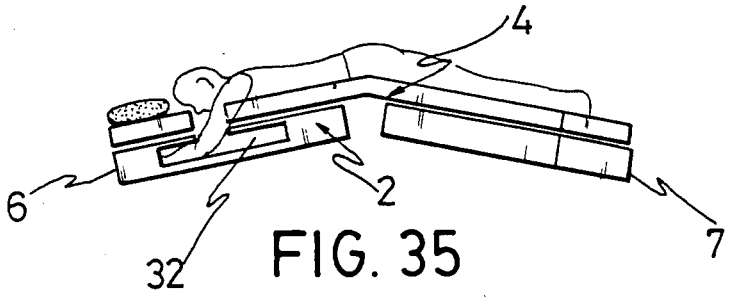
FIGS. 35 to 40 are schematic elevational views showing the different positions which a patient may adopt on the electrobed, especially relating to the posture of his arms.
Figure 36:
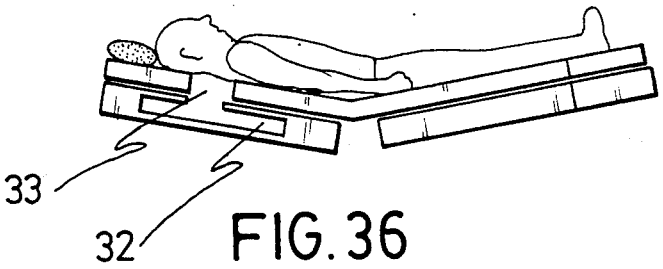
Figure 37:
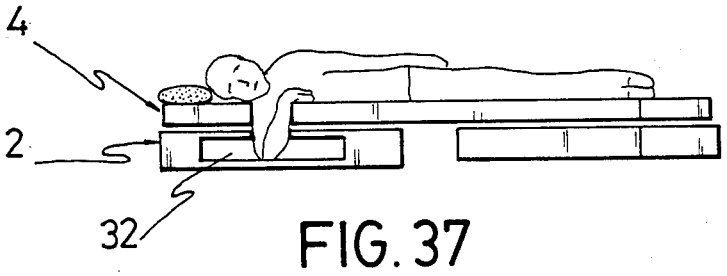
Figure 38:
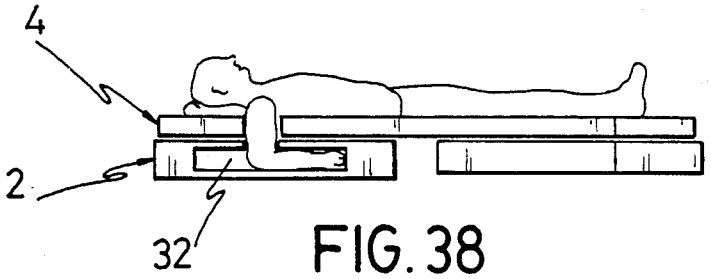
Figure 39:
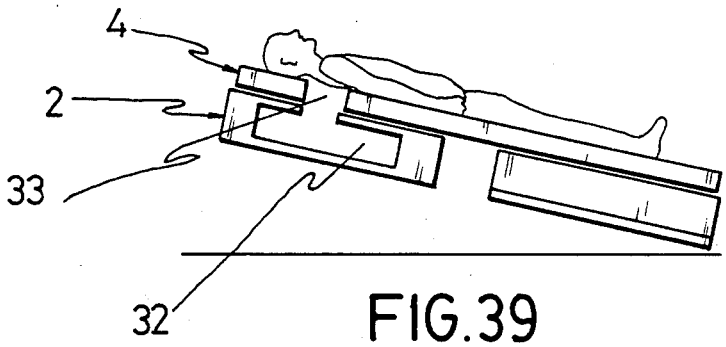
Figure 40:
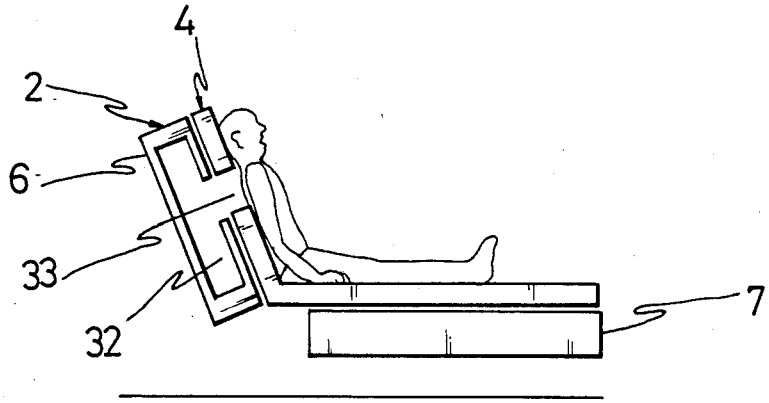

FIG. 34 also shows the disposition of the side covers 101 fixed to the platform 3, which hide the legs 46, having only three access gates 102 for making possible the regulation thereof.

Figure 33:
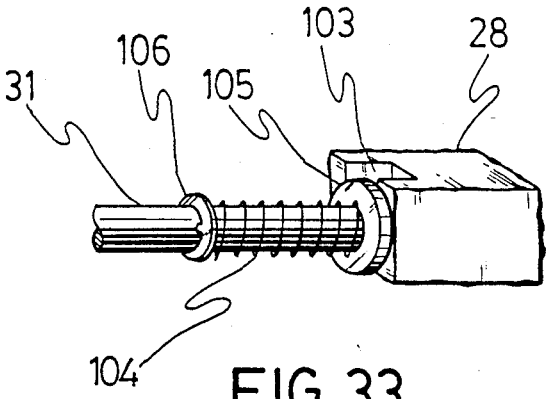
FIG. 33 is a detail in perspective, wherein the mechanisms for the manual displacement of the upper and movable plates of the head are shown.

FIG. 33 shows an enlarged detail of the handle 31 (see FIG. 8) for the displacement of the movable legs 28 of the head 1. This Figure shows that, in order to make the "V"-positioning possible, the ends of said handle 31 are pivotable anchored in both slots 103 of said plates, and therein restrained by a spring 104 which presses on a washer 105, and is supported at the opposite end by a fixed washer 106.

In case of a cutout in the electric supply, the invention permits the manual operation on the head 1 elevation mechanism, by means of a handle 107 (see FIG. 32) which sets in an adequate location provided at the rear portion of the electric motor 9 rotor axis. It also allows the manual operation on the angular positioning mechanism of the spring-mattress 2 bodies 6 and 7, by operating the handle 108 (see FIG. 17), connected to a projection 109 of the pinion 57 axis, there being another handle with similar characteristics, having not been represented in the Figures, for the manual operation of the mechanism for the elevation of the central pair of legs.

In case it was desired to join two beds according to the invention, the platform front faces may include coupling means, the releases 45 operating on the rollers 38 for the bedclothes 39, being assembled in this case at the outer portion of the whole in order to make the access thereto possible.

As is can be inferred from FIGS. 35 to 40, wherein some of the positions which the bed and the patient lying thereon can adopt are shown as an example, the transverse cluster of slots 32 of the front body 6 of the spring-mattress 2 plays an important role, as it allows the patient arm or arms to be placed on it by making them pass through the slot 33 of the mattress 4. This disposition allows the patient to undergo a therapeutic treatment on his arms, because they adopt the best posture, they are restrained, etc.

The shape defined by the cluster of slots 32 of the spring-mattress will therefore have a geometry adequate for the different positions of the arm or arms situated in its inside.

I claim:

1. An adjustable electrobed comprising:

(a) a head supported by a spring-mattress, being adjustable in height and in a horizontal position, comprising two independent elements hinged to a spring-mattress support, on axes longitudinal thereto and being able to adopt an adjustable "V" shaped position by the operation of an electric motor which turns two transverse threaded small-spindles to displace two nuts mounted thereon in opposite directions, said nuts being connected to head elements by means of articulated braces, each one of the independent head elements comprising two superimposed plates, the upper one being able to displace along guiding tracks providing at the lower one; a head support comprising two telescopically mounted tubular elements connected by a coaxially mounted spring and a locking mechanism on one of said elements for locking said support at a maximum desired position;

(b) a spring-mattress comprising first and second rigid bodies hinged together at a spring-mattress paracentral area, the first body being nearest the head and having at least one transverse cluster of slots, the spring-mattress being supported upon three pair of legs each having a damping mechanism, two pairs being situated on the second body opposite the head, said third pair being situated at a paracentral area of the first body, an angle between said bodies being made by small-spindles arranged transversely to the spring mattress and as a junction between an upper portion of the pairs of legs being nearest the head and the central pairs of legs, said small-spindles being operated by corresponding independent electric motors which displace pairs of nuts towards or away from each other said nuts being joined by braces to fixed points on the spring-mattress, each brace having two degrees of freedom, the upper end of the legs most opposite the head being pivotally anchored to the spring-mattress; and limit switches for stopping said motors at maximum and minimum displacement positions of the head end of the spring-mattress;

(c) a platform whereon said legs are fixed and supported;

(d) a pneumatic mattress, superimposed on the spring-mattress and provided with a cluster of slots corresponding to that of the latter, said cluster of slots being able to be plugged by a rack closure, said mattress having an elasticity that is adjustable by changing its inflation pressure by means of a manual pump-damper provided at the spring-mattress front body.

2. An adjustable electrobed, according to claim 1, wherein the transversal spring-mattress cluster of slots penetrates into the whole thickness of the spring-mattress and has a "L"-vertical section.

3. An adjustable electrobed, according to claim 1, wherein rear and inner portions of the spring-mattress includes at least one transversal roller, around which bedclothes are rolled up, with fringes being folded over it, said bedclothes emerging through a longitudinal window performed in a rear gate of the spring-mattress.

4. An adjustable electrobed according to claim 3, wherein said roller includes spring means tensioned when said bedclothes are unwound from said roller and winding up said bedclothes upon actuation of a release.

5. An adjustable electrobed according to claim 1, wherein the articulated hinging of both spring-mattress rigid bodies is achieved by a plurality of one of linked and zigzagged hinges, the angle being selected by one of said hinges, the remainder blocked by "U"-clamps with parallel arms with respect to an axis, which pass through corresponding holes of axial direction, thereby varying the relative length of the spring-mattress bodies with respect to the total length thereof.

6. An adjustable electrobed according to claim 1, wherein said pneumatic mattress comprises a series of one of prismatic cells and air springs joined to each other, being connected through a capillary drilling central to common faces of said cells, for restraining the passage of air according to the weight of a human body supported by the said bed, the pressure being balanced at a pneumatic damper having a circuit including a pressure manometer.

* * * * *

UNITED STATES PATENT AND TRADEMARK OFFICE

CERTIFICATE OF CORRECTION

PATENT NO. : 4,785,487

DATED : November 22, 1988

INVENTOR(S) : Manuel BERNEDO TORAN

It is certified that error appears in the above-identified patent and that said Letters Patent is hereby corrected as shown below:

Title page: item 76 "Manuel B. Toran" should read
-- Manuel Bernedo Toran --

Title page: item 76 "Avda. Erasa, 10-2a fase, Benalmadena (Malaga), Spain" should read
-- Finisterre 13, 28029, Madrid, Spain --

Signed and Sealed this

Sixteenth Day of April, 1991

*Attest:*

*Attesting Officer*

HARRY F. MANBECK, JR.

*Commissioner of Patents and Trademarks*